US008602806B2

(12) United States Patent
Chou et al.

(10) Patent No.: US 8,602,806 B2
(45) Date of Patent: Dec. 10, 2013

(54) ELECTRICAL PLUG FASTENER

(75) Inventors: Chia-Shin Chou, New Taipei (TW); Xiao-Feng Ma, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 50 days.

(21) Appl. No.: 13/396,604

(22) Filed: Feb. 15, 2012

(65) Prior Publication Data

US 2013/0059459 A1 Mar. 7, 2013

(30) Foreign Application Priority Data

Sep. 6, 2011 (CN) ..... 2011 1 0262078

(51) Int. Cl.
*H01R 4/50* (2006.01)
*H01R 13/625* (2006.01)

(52) U.S. Cl.
USPC ..... 439/345; 439/471

(58) Field of Classification Search
USPC ..... 439/345, 471, 458, 346, 369, 370
See application file for complete search history.

(56) References Cited

U.S. PATENT DOCUMENTS

| | | | | |
|---|---|---|---|---|
| 2,406,030 | A * | 8/1946 | O'Brien | 439/353 |
| 7,101,215 | B2 * | 9/2006 | Woellner et al. | 439/371 |
| 2007/0270025 | A1 * | 11/2007 | Mabry | 439/470 |
| 2010/0233898 | A1 * | 9/2010 | Hayden, Sr. | 439/346 |
| 2012/0315772 | A1 * | 12/2012 | Joschika | 439/55 |

* cited by examiner

*Primary Examiner* — Hae Moon Hyeon
(74) *Attorney, Agent, or Firm* — Altis Law Group, Inc.

(57) ABSTRACT

A plug fastener is provided to avoid a plug with a power line disengaging from a power strip. The plug fastener includes two fixing members, two connecting clips, and a fixing clip. The fixing members are detachably engaged with each other for sandwiching the power line therebetween. The fixing clip is placed around the power strip. A first end of each of the connecting clips is rotatably connected to the fixing clip, and a second end of each of the connecting clips opposite to the first end is rotatably connected to a respective one of the fixing members.

11 Claims, 4 Drawing Sheets

ELECTRICAL PLUG FASTENER

BACKGROUND

1. Technical Field

The present disclosure relates to a plug fastener for keeping an electrical plug in place.

2. Description of Related Art

When a number of servers are tested at the same time, a number of corresponding plugs and power lines are connected to some power strips. The power lines can become tangled with one another. When pulling one of the plugs out from a power strip, there is a risk of one or more other plugs being disengaged from the power strip.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references can mean "at least one."

Figure 1:
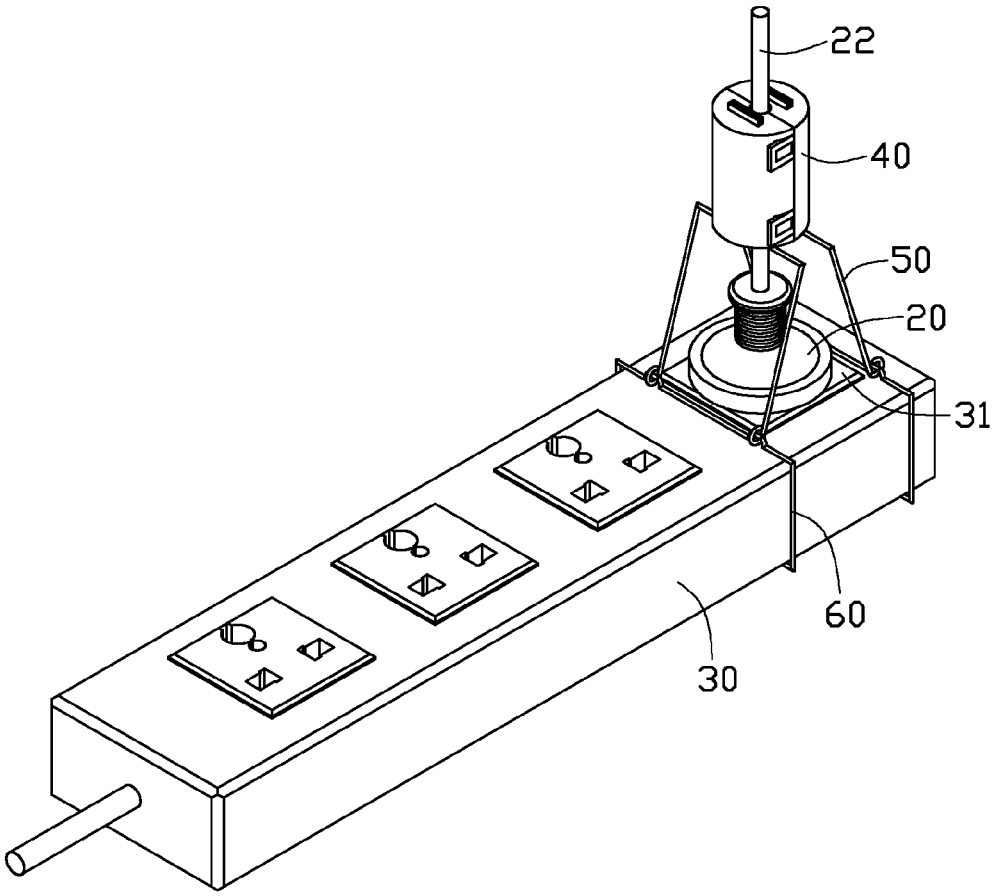
FIG. 1 is an assembled, isometric view of an exemplary embodiment of a fastener, together with a plug and a power strip, wherein the fastener includes two fixing members.

Referring to FIG. 1, an exemplary embodiment of a fastener is illustrated. The fastener is provided to avoid a plug 20 disengaging from a power strip 30. Some power outlets 31 are formed on the top of the power strip 30. A power line 22 extends from a rear end of the plug 20. The fastener includes two identical fixing members 40, two identical connecting clips 50, and a fixing clip 60.

Figure 2:
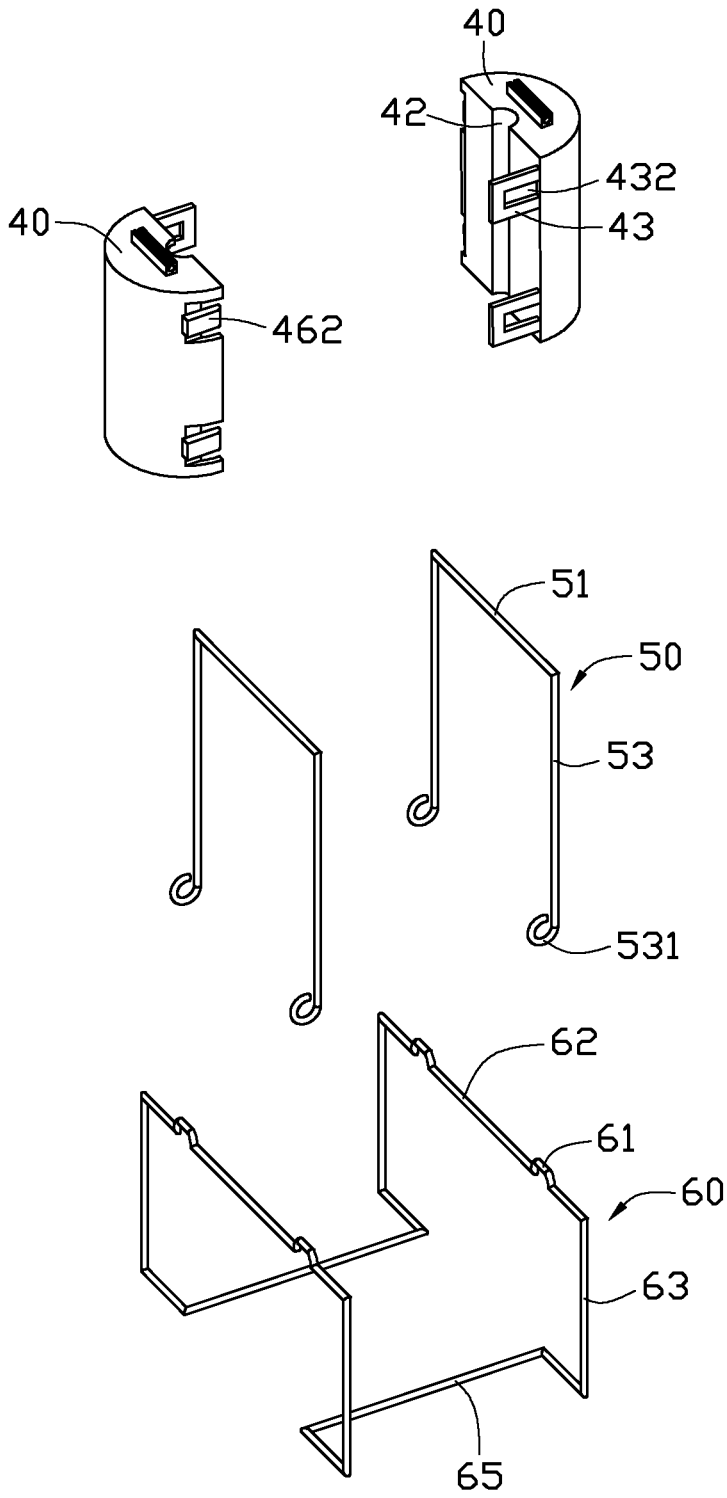
FIG. 2 is an exploded, isometric view of the fastener of FIG. 1.
Figure 3:
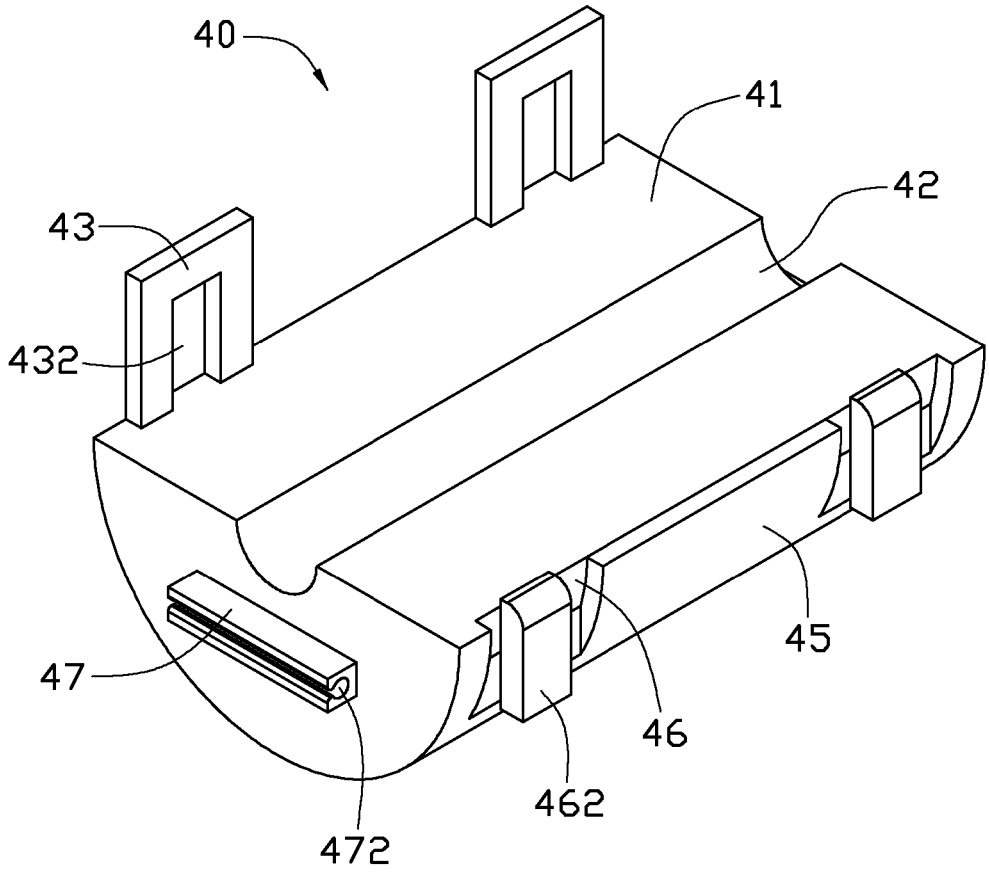
FIG. 3 is an enlarged view of one of the fixing members of FIG. 2, but viewed from another perspective.

Referring also to FIGS. 2 and 3, each fixing member 40 is made of a material that can avoid electromagnetic interference, such as ultra-crystallite or ferrite, for shielding electromagnetic radiation of the power line 22. Each fixing member 40 is substantially semicylindrical-shaped. Each fixing member 40 includes a flat first sidewall 41 and a semicircular-shaped second sidewall 45 connected between opposite longitudinal sides of the first sidewall 41. A semicylindrical groove 42 is longitudinally defined in the middle of the first sidewall 41, with two ends of the groove 42 extending through opposite ends of the fixing member 40. Two spaced latches 43 protrude from one of the longitudinal sides of the first sidewall 41, and are substantially perpendicular to the first sidewall 41. Each latch 43 defines a through slot 432. Two spaced hooking slots 46 are defined in the second sidewall 45 where the second sidewall 45 adjoins the other longitudinal side of the first sidewall 41, with an end of each hooking slot 46 extending through the first sidewall 41. Two blocks 462 respectively and slantingly extend outwards from the second sidewall 45 at centers of the hooking slots 46. The blocks 462 are substantially perpendicular to the first sidewall 41.

An elongated mounting portion 47 protrudes from the bottom end of the fixing member 40. The mounting portion 47 is located between the bottom edges of the first sidewall 41 and the second sidewall 45, and is oriented parallel to the first sidewall 41. A pivot slot 472 is longitudinally defined in the mounting portion 47, with two ends of the pivot slot 472 extending through opposite ends of the mounting portion 47. In the illustrated embodiment, another elongated mounting portion 47 protrudes from the top end of the fixing member 40. This other mounting portion 47 is located between the top edges of the first sidewall 41 and the second sidewall 45, and is oriented parallel to the first sidewall 41.

Each connecting clip 50 is formed from bending a wire, and is substantially U-shaped. Each connecting clip 50 includes a first pole 51, and two second poles 53 extending perpendicularly down from opposite ends of the first pole 51. The distal end of each second pole 53 forms a hook 531.

The fixing clip 60 is a rectilinear frame formed from bending a wire. The fixing clip 60 includes two parallel top poles 62, two side poles 63 extending perpendicularly down from opposite ends of each top pole 62, and two U-shaped bottom poles 65 each extending perpendicularly from bottom ends of two corresponding side poles 63. The two corresponding side poles 63 extend from same ends of the top poles 62, and the bottom pole 65 interconnects the bottom ends of the two corresponding side poles 63. The two bottom poles 65 lie in a same plane that is parallel to the top poles 62, and the two bottom poles 65 extend towards each other. Each top pole 62 upwardly forms two spaced latching portions 61.

Figure 4:
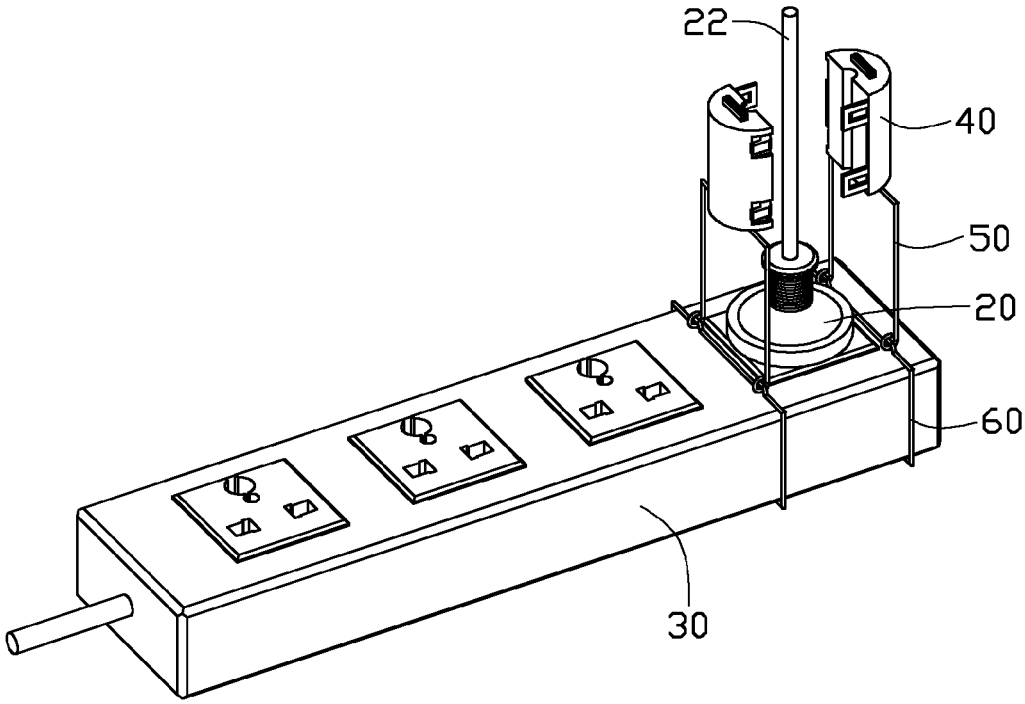
FIG. 4 is similar to FIG. 1, but showing the fixing members unclasped from each other.

Referring to FIGS. 1 and 4, in assembly, firstly, the fixing clip 60 is placed around the power strip 30. The top poles 62 abut against the top surface of the power strip 30 and are respectively located at opposite sides of a corresponding power outlet 31. The side poles 63 respectively abut against opposite long side surfaces of the power strip 30. The bottom poles 65 abut against a bottom surface of the power strip 30. Secondly, the first poles 51 are respectively and rotatably engaged in the pivot slots 472 of the bottom mounting portions 47 of the corresponding fixing members 40. Thirdly, the hooks 531 of each connecting clip 50 rotatably hook the corresponding latching portions 61 of the corresponding top pole 62. Fourthly, the plug 20 is inserted into the power outlet 31. Fifthly, the fixing members 40 are moved towards each other, to allow the power line 22 to be received in the grooves 42. The latches 43 of each fixing member 40 respectively engage in the corresponding hooking slots 46 of the other fixing member 40, with the blocks 462 of each fixing member 40 engaging in the corresponding through slots 432 of the other fixing member 40. The fixing members 40 are thus clasped to each other, with the first sidewalls 41 abutting against each other. The power line 22 is sandwiched between the fixing members 40, to avoid the plug 20 connected to the power line 22 accidentally disengaging from the power outlet 31.

To disengage the plug 20 from the power outlet 31, the latches 43 of each fixing member 40 are respectively disengaged from the corresponding hooking slots 46 of the other fixing member 40. The fixing members 40 are moved away from each other, to allow the connecting clips 50 respectively connected to the fixing members 40 to rotate away from each other. Then the plug 20 can be easily removed from the power outlet 31 of the power strip 30.

Even though numerous characteristics and advantages of the embodiments have been set forth in the foregoing description, together with details of the structures and the functions of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

What is claimed is:

1. A fastener for avoiding a plug with a power line accidentally disengaging from a power strip, the fastener comprising:

two fixing members detachably engagable with each other for sandwiching the power line therebetween;

a fixing clip configured to be placed around the power strip; and two connecting clips, wherein a first end of each of the connecting clips is rotatably connected to the fixing clip, and a second end of each of the connecting clips opposite to the first end is rotatably connected to a respective one of the fixing members.

2. The fastener of claim 1, wherein each fixing member comprises a first sidewall, the first sidewalls of the fixing members abut against each other when the fixing members are engaged with each other, a groove is defined in each first sidewall, extending through opposite ends of the fixing member, and the grooves of the fixing members communicate with each other when the fixing members are engaged with each other for cooperatively receiving the power line.

3. The fastener of claim 2, wherein each fixing member further comprises a latch and a block at opposite sides of the groove, respectively, and the block of each fixing member is engaged with the latch of the other fixing member when the fixing members are engaged with each other.

4. The fastener of claim 3, wherein each fixing member defines a hooking slot surrounding the block, and the latch of each fixing member is engaged in the hooking slot of the other fixing member when the fixing members are engaged with each other.

5. The fastener of claim 3, wherein a mounting portion protrudes from an end surface of each fixing member, a pivot slot is defined in the mounting portion, and each connecting clip comprises a first pole rotatably engaging in a corresponding pivot slot.

6. The fastener of claim 5, wherein each connecting clip further comprises two second poles extending from the first pole towards the fixing clip, a distal end of each second pole forms a hook, the fixing clip comprises two top poles configured to abut against a top surface of the power strip, each top pole forms two latching portions, and the hooks of each connecting clip respectively and rotatably hook the latching portions of a corresponding top pole.

7. The fastener of claim 6, wherein the fixing clip further comprises four side poles and two bottom poles, two of the side poles extend down from opposite ends of one of the top poles and are configured to abut against opposite side surfaces of the power strip, the other two side poles extend down from opposite ends of the other top pole and are configured to abut against the two opposite side surfaces of the power strip, one of the bottom poles is connected between bottom ends of the two side poles configured to abut against one of the opposite side surfaces of the power strip, the other bottom pole is connected between bottom ends of the two side poles configured to abut against the other one of the opposite side surfaces of the power strip, and the two bottom poles are configured to abut against a bottom surface of the power strip.

8. The fastener of claim 1, wherein each fixing member is made of material that shields electromagnetic radiation.

9. The fastener of claim 8, wherein the material is one of ultra-crystallite and ferrite.

10. The fastener of claim 1, wherein the fixing members are identical, and the connecting clips are identical.

11. A fastener for holding a power line of a plug connected to a power strip, the fastener comprising:

two fixing members detachably engaged with each other thereby clamping the power line therebetween;

a fixing clip fixed around the power strip; and two U-shaped connecting clips;

wherein free ends of each of the connecting clips are pivotably connected to the fixing clip, and a top end of each of the connecting clips opposite to the free ends is pivotably connected to a respective one of the fixing members; and when the fixing members are detached from each other, the top end of one of the connecting clips pivots in a clockwise direction relative to the corresponding fixing member while the free ends of said one of the connecting clips pivot in clockwise directions, and simultaneously the top end of the other connecting clip pivots in a counterclockwise direction relative to the corresponding fixing member while the free ends of the other connecting clip pivot in counterclockwise directions.

* * * * *